US008390476B2

(12) United States Patent
Lock

(10) Patent No.: US 8,390,476 B2
(45) **Date of Patent: *Mar. 5, 2013**

(54) IMAGE RECORDING APPARATUS AND METHOD

(75) Inventor: Roy William Lock, Park Orchards (AU)

(73) Assignee: Redflex Traffic Systems Pty Ltd, South Melbourne, Victoria (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/162,359

(22) Filed: Jun. 16, 2011

(65) Prior Publication Data

US 2011/0273566 A1 Nov. 10, 2011

Related U.S. Application Data

(63) Continuation of application No. 11/133,939, filed on May 20, 2005, now Pat. No. 7,986,248, which is a continuation of application No. 10/070,315, filed on Jun. 10, 2002, now Pat. No. 6,919,823.

(51) Int. Cl.
*G08G 1/017* (2006.01)

(52) U.S. Cl. ..... 340/937; 340/933; 340/938; 340/916

(58) Field of Classification Search ..... 340/937, 340/905, 933, 938, 916, 921; 348/149; 701/117, 701/300, 301, 302

See application file for complete search history.

(56) References Cited

U.S. PATENT DOCUMENTS

| | | | | |
|---|---|---|---|---|
| 4,884,072 | A * | 11/1989 | Horsch | 340/937 |
| 5,809,161 | A * | 9/1998 | Auty et al. | 382/104 |
| 6,919,823 | B1 * | 7/2005 | Lock | 340/937 |
| 7,986,248 | B2 * | 7/2011 | Lock | 340/937 |

* cited by examiner

*Primary Examiner* — Anh V La

(74) *Attorney, Agent, or Firm* — Dergosits & Noah LLP; Todd A. Noah

(57) ABSTRACT

An image recording apparatus suitable for recording a traffic signal violation at an intersection controlled by a traffic light is described. The image recording apparatus includes a first camera focused on the intersection, and a second camera focused on a first lane of a street leading to the intersection. A first control circuit is coupled to the first camera causes the first camera to capture a first image at substantially an instant of time that the traffic light indicates a change of traffic control status. The apparatus also includes a detection circuit to detect when a portion of a vehicle crosses a trigger location in the first lane after the change in traffic control status. A second control circuit coupled to the second camera causes the second camera to capture a close-up image of the vehicle in the event that the detection circuit detects the portion of the vehicle at the trigger location after a change in traffic control status.

20 Claims, 4 Drawing Sheets

IMAGE RECORDING APPARATUS AND METHOD

CROSS-REFERENCE TO RELATED APPLICATIONS

The present application is a continuation of currently pending U.S. patent application Ser. No. 11/133,939, filed on May 20, 2005, now U.S. Pat. No. 7,986,248 entitled, "Image Recording Apparatus And Method," which is a continuation of U.S. patent application Ser. No. 10/070,315, filed on Jun. 10, 2002, now U.S. Pat. No. 6,919,823 entitled, "Image Recording Apparatus And Method." Both U.S. Pat. Nos. 7,986,248 and 6,919,823 are thereby incorporated by reference and assigned to the assignee of the present application.

BACKGROUND OF THE INVENTION

The present invention relates to image recording apparatus suitable for automatically recording traffic signal violations, such as failure of a vehicle to stop at a red traffic control signal at an intersection, a crossing for pedestrians or other location where traffic signals are used to control vehicular traffic.

Prior art recording devices for this purpose incorporate automatic camera systems which are triggered when a vehicle fails to stop after a traffic light turns red. A typical device may be triggered by a road sensor such as an inductive loop or loops installed below the road surface which senses the presence of a motor vehicle after it crosses a marked stop line associated with the traffic signal. The road sensor may alternatively be of the piezo type, and may be triggered when a vehicle touches the sensor installed within the road surface. Piezo type sensors are used when recording of accurate vehicle speed is required in addition to traffic light violation.

The usual method of recording images is by photographic means using 35 mm film. Two images (photographs) are recorded of each violation. One image is recorded as the vehicle proceeds over the stop line associated with the traffic signal and a further image is recorded approximately one half second later (or more depending upon the size of the intersection) to establish movement of the vehicle. In each photograph a data inset is included showing the date, time of day and the time (in seconds) that traffic lights had been red when the violation took place. Note that if only one photograph was taken, there would be no way of determining whether the vehicle actually proceeded through the intersection, turned left or right or stopped just over the stop line.

A disadvantage of prior art recording devices is that the position of the vehicle relative to the stop line when the lights turned red, is not known and can only be crudely estimated from the distance traveled by the vehicle in the two photographs taken, plus the red light time shown on the data inset in each photograph. In the case of a defended matter in Court, the prosecution must prove that the lights were red before the vehicle concerned proceeded across the stop line. To ensure that this does in fact happen in each case, the cameras are set so that at least one half second of red light time elapses before the road sensors are enabled. As a result of this requirement many vehicles actually proceed through the red light without being detected during the first half second of red light time.

Bearing in mind that the distance covered by a vehicle in the first half second of red signal is dependant on vehicle speed, it is apparent that only the worst cases of red light traffic infringements ever get captured by the camera. There are considerably more red light traffic infringements occurring during the first half second of red signal which could be detected.

An object of the present invention is to provide image recording apparatus which alleviates the disadvantages of the prior art.

SUMMARY OF THE INVENTION

According to one aspect of the present invention there is provided an image recording apparatus suitable for recording traffic signal violations, said apparatus including:

means for capturing a first image substantially at an instant of time that a control signal changes its status;

means for storing said first image at least temporarily;

means for detecting presence of a vehicle or object beyond a location at which said vehicle or object is required to stop in response to said change in status; and means responsive to said detecting means for recording said first image in the event that said detecting means detects presence of said vehicle or object beyond said location.

The image recording apparatus according to the present invention may be adapted to record an image substantially at the moment that a traffic light changes to red. The image may be recorded whether or not an infringement actually takes place. The image recording apparatus may use digital capture technology to avoid the cost of an unused photograph when no violation occurs. Software controlling recording of the digital image may store the image in a temporary memory such as a volatile memory e.g., RAM until the duration of the read light cycle is completed.

If no vehicle is detected by road sensors during that cycle, the software may remove the image from the temporary memory. If an infringement does take place, the image may be transferred from temporary memory to a more permanent location. Because the image was recorded substantially at the time that the light changed to red, it should clearly show the position of the vehicle relative to the stop line when the light changed to red, providing excellent evidence for prosecution.

The apparatus of the present invention, may record additional images using cameras provided with wide angle and telephoto lenses. The wide angle image may show the whole of the intersection including the status of the traffic lights. The telephoto image may show a close up image of the offending vehicle and may provide a clear view of its number plate. Cameras incorporating wide angle and telephoto lenses may be of the kind discloses in International Patent Application PCT/AU94/00260, the disclosure of which is incorporated herein by cross reference. The apparatus may be arranged such that one camera fitted with a telephoto lens monitors each traffic lane individually. The data inset in the recorded image may show real time, date and red light time of the infringement as well as identifying the traffic lane in which a vehicle was detected.

If a traffic accident occurs as a result of a traffic light violation, the images recorded may provide graphic details of the sequence of events leading up to the accident and an image of the collision itself. This may provide vital evidence, particularly at a Coroners Inquest for determining the culpability of a driver when a fatal accident occurs. This aspect of the invention is particularly relevant, bearing in mind that many red light violations have been undetected with conventional red light camera technology.

According to a further aspect of the present invention there is provided a method of recording traffic violations including the steps of:

capturing a first image substantially at an instant of time that a control signal changes its status;

storing said first image at least temporarily;

detecting presence of a vehicle or object beyond a location at which said vehicle or object is required to stop in response to said change in status; and recording said first image in the event that said detecting means detects presence of said vehicle or object beyond said location.

DESCRIPTION OF THE DRAWINGS

A preferred embodiment of the present invention will now be described with reference to the accompanying drawings wherein:—

DETAILED DESCRIPTION

Figure 1:
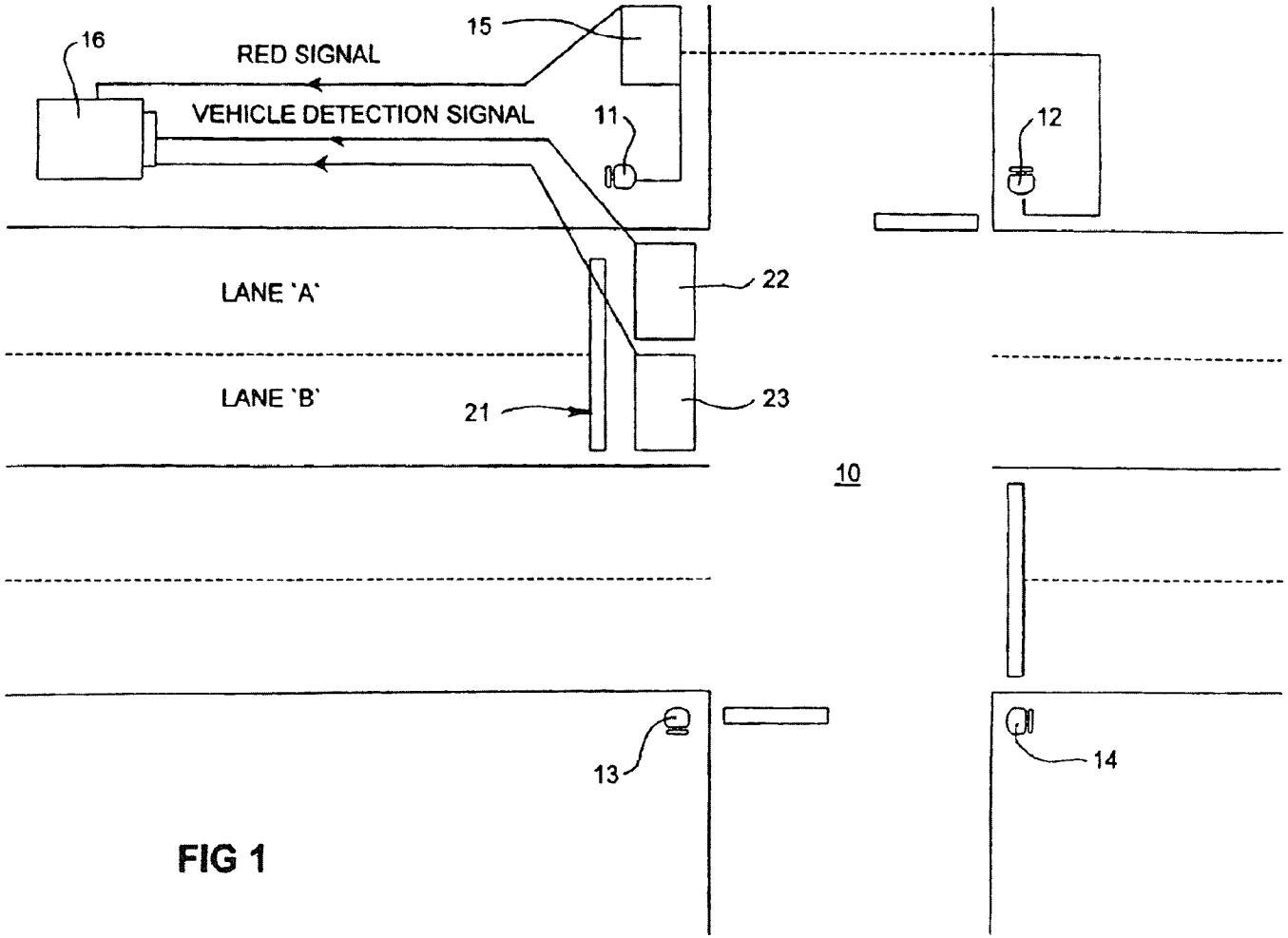
FIG. 1 shows a plan view of an intersection with a traffic light camera installation.

FIG. 1 shows a typical intersection 10 of two roads controlled by traffic lights 11-14. Traffic lights 11-14 are cycled between the colours red, amber and green via a control unit 15. Although traffic lights 11-14 are associated with a roadway configured for left-hand drive traffic, the principles of the present invention apply equally to right-hand drive traffic.

Intersection 10 is monitored by image recording apparatus according to the present invention. The recording apparatus is located in a roadside housing 16 located approximately 10-40 metres from intersection 10, giving a view of the roadway leading up to the intersection and the intersection 10 itself.

Figure 2:
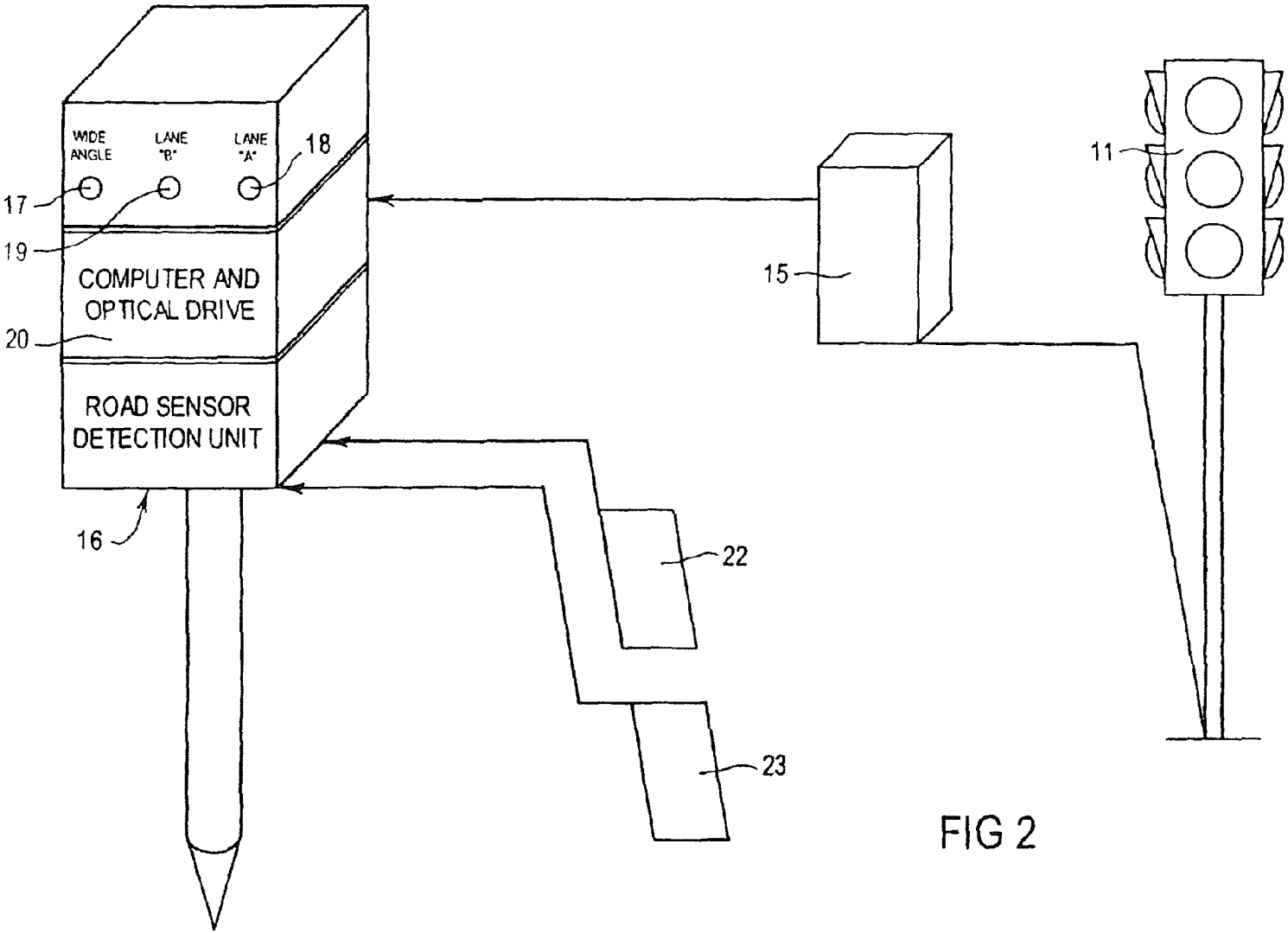
FIG. 2 shows a closeup view of components of the installation.

The apparatus includes digital cameras 17-19 (refer FIG. 2) connected to a digital computer 20 within housing 16 for recording digital images of the intersection in the event of a red light infringement, i.e., a vehicle fails to stop and proceeds past white stop line 21 marked on the roadway associated with traffic light 11, after light 11 has turned red.

One or more of cameras 17-19 may be triggered when a vehicle passes over a road sensor 22, 23 such as an inductive loop or loops set below the road surface forward of stop line 21. As the vehicle crosses sensor 22 or 23 and the traffic light 11 is red, a trigger signal is sent to cameras 17-19 to record two images in sequence. One image may be recorded as the vehicle crosses sensor 22 or 23 and another image may be recorded approximately one half second later (this may vary depending on the intersection).

Cameras 17-19 may be enabled when light 11 has turned red and may remain enabled for the whole of the red cycle. Cameras 18 and 91 may be triggered when the vehicle crosses road sensors 22 and 23 respectively during the red cycle.

For an infringement to have occurred it is imperative to establish that the vehicle concerned was some distance behind stop line 21 when traffic light 11 turned red. In a case of a prosecution of an infringement in Court based on evidence obtained by an automatic unattended camera device, this must be proven by some means.

According to the present invention, camera 17 fitted with a wide angle lens may capture an image of the approach to intersection 10 at the moment that traffic light 11 turns red. The wide angle image may show the position of a vehicle approaching the intersection at that time. The wide angle image may be in addition to any later images recorded as the result of the triggering of the camera if the vehicle subsequently crosses road sensor 22 or 23 during the red cycle.

If an eventual infringement takes place during the red cycle by a vehicle, then the position of that vehicle relative to stop line 21, will be clearly seen and recorded in the wide angle image.

If no infringement takes place during the ensuing red light cycle, the wide angle image may be automatically removed from images stored in the computer following completion of the red light cycle. If an infringement is detected, the wide angle image may be retained with images taken subsequently when the vehicle enters the intersection.

The images may be stored under control of computer software. In the event of infringement, the images may be recorded relatively permanently by means such as an optical recording device using Write Once Read Many times (WORM) type media. One advantage of using WORM type media is that the images and data representing an infringement cannot be easily altered or erased. The optical recording device may be contained within housing 16.

There are physical connections between the traffic lights 11 to 14, control unit 15, road sensors 22, 23, cameras 17 to 19 and the image recording device to enable triggering and operation of the apparatus.

Computer software may control operation of the camera or cameras within housing 16. In the present example camera 17 fitted with a wide angle lens may be used to record the commencement of the red light cycle. Camera 18 is fitted with a telephoto lens and may be used to record a first close up image of the vehicle crossing stop line 21 and a second image of the vehicle within the intersection one half second later. Where there are two traffic lanes on the approach to the intersection then a further camera (19) may be fitted with a telephoto lens and used for the second traffic lane. Where these are more than two traffic lanes, then a separate camera fitted with a telephoto lens may be used for each traffic lane.

Operation of multiple cameras and the images they record may be under software control.

Each image recorded may include an inset within the image showing time, date and location of an infringement and may show red light time, i.e., the time in seconds and tenths of seconds that the signal had been showing red.

Images recorded in the event of an infringement may also identify the relevant lane, e.g., by number (when there are multiple lanes) to show which lane sensor 22, 23 was triggered during the infringement.

Figure 3:
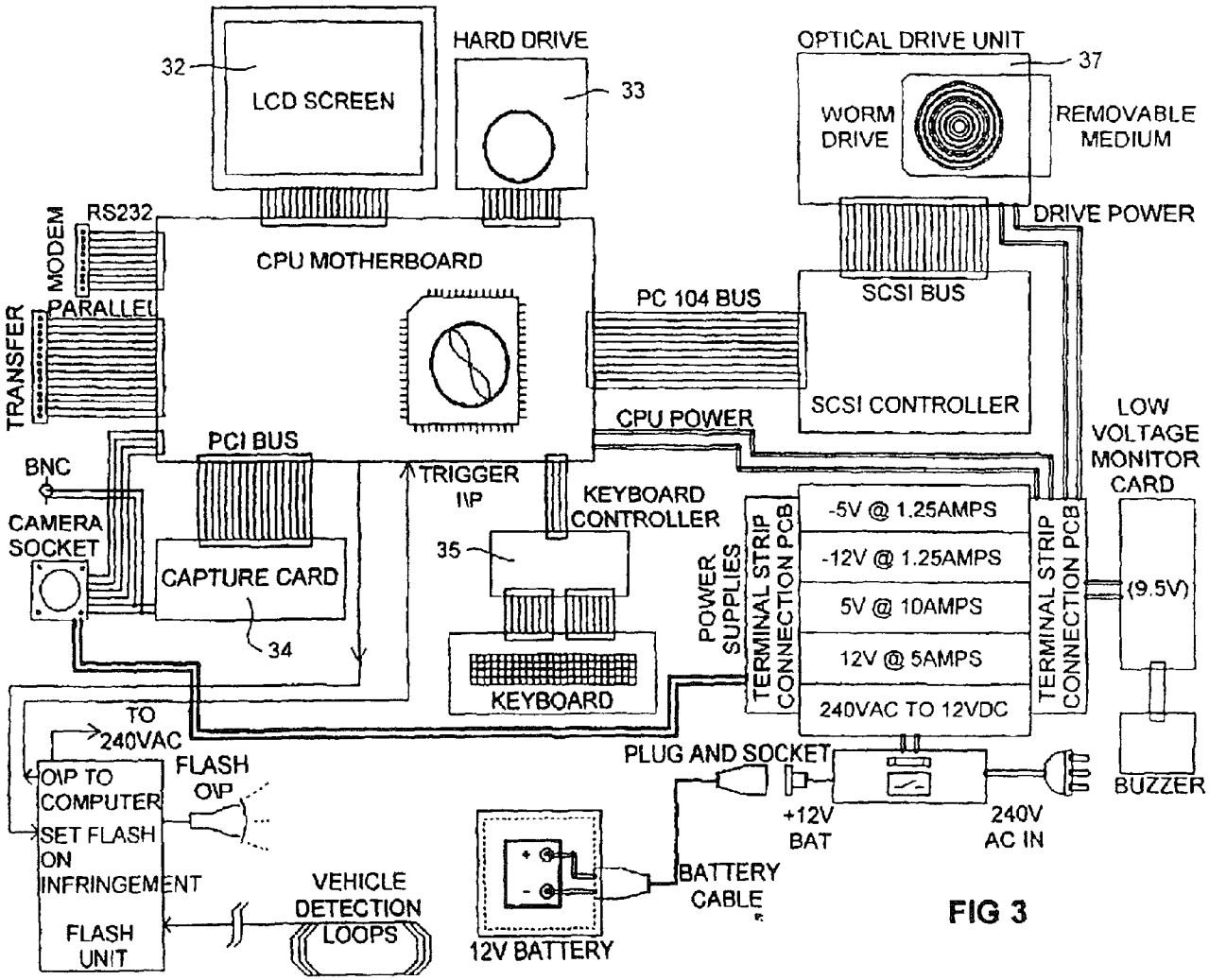
FIG. 3 shows a block diagram of a computer based controller for the traffic light camera installation.

FIG. 3 shows one form of digital computer 20, which may be adapted to control operation of cameras 17-19 and one or more image recording devices. Computer system 20 includes CPU motherboard 31 to which are connected a number for peripherals including LCD display screen 32, hard disc drive 33, video capture card 34, keyboard controller 35 and SCSI controller 36. Motherboard 31 includes on board RAM memory (not shown) as in known in the art. The image recording devices include the on board RAM memory (temporary storage) and an optical drive unit 37.

Figure 4:
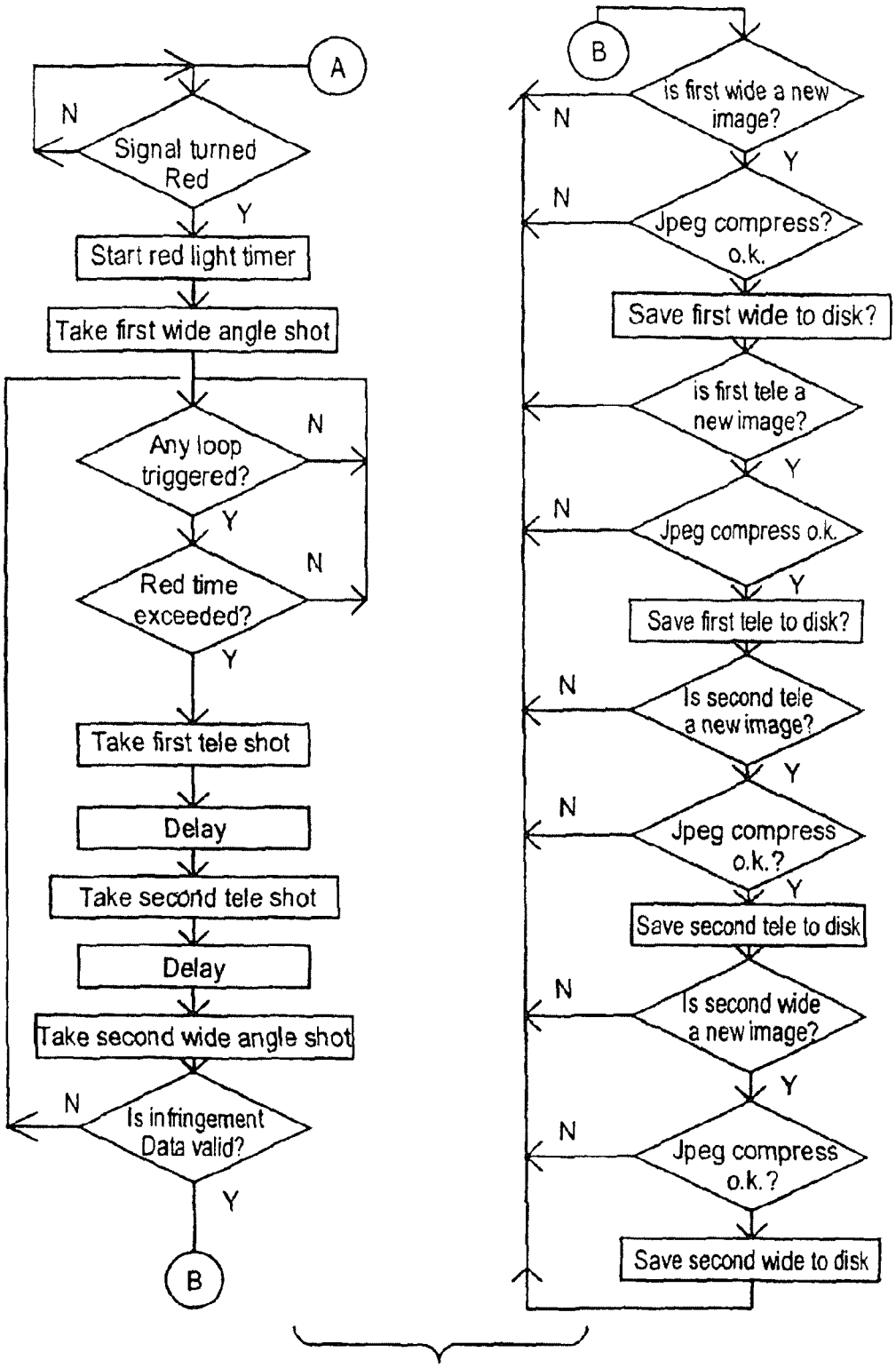
FIG. 4 shows a flow diagram of software associated with the computer based controller.

FIG. 4 shows a flow chart of software, which may be used to control the image capture sequence.

Every time a traffic signal turns red (thru lanes or turn arrow), a wide-angle image is recorded at the instant of light change to red and the image is saved in computer RAM memory, i.e., it is not yet saved to disk. The wide-angle image shows all traffic lights visible to a driver on that side of the road and all lanes through the intersection.

If an infringement is detected, a second image is recorded which shows a close-up (telephoto) image of the vehicle. If no infringement occurs during this red light cycle, the first wide-angle image is discarded and nothing is written to disk.

After a delay of approximately 300 milliseconds (this value may be adjustable), another close-up image is recorded so as to prove movement of the vehicle past the detection point.

After another similar delay a second wide-angle image is recorded for confirmation of the position of the infringing vehicle in the detected lane and that the traffic lights is still red.

At this point the images and data associated with the infringements are transferred from RAM memory to disk. Should an error occur during any of the above-processes, the images are discarded and not saved to disk.

Finally, it is to be understood that various alterations, modifications and/or additions may be introduced into the constructions and arrangements of parts previously described without departing from the spirit or ambit of the invention.

What is claimed is:

1. An image recording apparatus comprising:

a wide angle camera focused on an intersection;

a first lane camera focused on a first lane of the intersection;

a second lane camera focused on a second lane of the intersection;

a first detection circuit configured to emit an infringement signal if at least a portion of a first vehicle in the first lane or a second vehicle in the second lane positioned beyond a location of the intersection at which the first vehicle and the second vehicle are required to stop in response to the change in traffic control status; and a control circuit coupled to the wide angle camera, the first lane camera and the second lane camera wherein the control circuit is configured to cause the wide angle camera to capture an image of the intersection and to cause the first lane camera to capture a first image of the first vehicle in the first lane or the second lane camera to capture a first image of the second vehicle in the second lane in response to the infringement signal from the first detection circuit.

2. The image recording apparatus of claim 1 wherein, if the first detection circuit emits the infringement signal, the control circuit causes the first lane camera to capture a second image of the first vehicle after a first predetermined time period from the instant of time that the first image of the first vehicle was captured or the second lane camera to capture a second image of the second vehicle after the first predetermined time period from the instant of time that the first image of the second vehicle was captured.

3. The image recording apparatus of claim 2 further comprising:

a recording circuit coupled to the first detection circuit and configured to store the first image of the first vehicle or the first image of the second vehicle in a temporary memory and to delete the first image of the first vehicle or the first image of the second vehicle from the temporary memory in the event that the detection circuit does not detect the portion of the first vehicle or the second vehicle is beyond the location of the intersection at which the first vehicle and the second vehicle are required to stop in response to the change in traffic control status.

4. The image recording apparatus of claim 3 wherein, if the first detection circuit emits the infringement signal the recording circuit records each of the first image, the second image, a first close-up image, and a second close-up image to permanent memory.

5. The image recording apparatus of claim 1 further comprising:

a second detection circuit configured to detect the portion of the vehicle at a trigger location in the second lane after the change in traffic control status;

a third camera focused on the second lane of the street entering the intersection; and a third control circuit coupled to the third camera and configured to cause the third camera to capture a close-up image of the vehicle in the event that the second detection circuit detects the portion of the vehicle at the trigger location after a change in traffic control status.

6. The image recording apparatus of claim 1 wherein the first lane camera comprises a first telephoto camera focused on the first lane, and the second lane camera comprises a second telephoto camera focused on the second lane.

7. The image recording apparatus of claim 1 further comprising a compression circuit configured to the image size of the first image and a close-up image.

8. The image recording apparatus of claim 7 wherein each of the wide angle camera, the first lane camera and the second lane camera comprise digital cameras, and wherein the compression circuit performs digital compression.

9. The image recording apparatus of claim 3 wherein the temporary memory comprises RAM.

10. The image recording apparatus of claim 1 wherein the detection circuit includes an inductive loop set below a road surface proximate to the intersection, and wherein the trigger location comprises a stop line marked on a roadway proximate said intersection.

11. An image recording apparatus comprising:

a first telephoto camera focused on a first lane of an intersection to capture a first number plate of a first vehicle;

a second telephoto camera focused on a second lane of the intersection to capture a second number plate of a second vehicle;

a detection circuit configured to emit an infringement signal if at least a portion of a the first vehicle in the first lane or the second vehicle in the second lane at a trigger location proximate the intersection after a change in traffic control status signaled by the traffic light; and a control circuit coupled to the first telephoto camera and the second telephoto camera, and configured to cause the first telephoto camera to capture a first image of the first number plate of the first vehicle in the first lane of the intersection or to cause the second camera to capture a second image of the second number plate of the second vehicle in the second lane of the intersection in response to the infringement signal from the detection circuit.

12. The image recording apparatus of claim 11 wherein, if the detection circuit emits the infringement signal, the control circuit causes the recording of each of the first image or second image to permanent memory.

13. The image recording apparatus of claim 11 wherein, if the detection circuit emits the infringement signal, the control circuit causes the first telephoto camera to capture a third image of the first vehicle after a first predetermined time period from the instant of time of the change of traffic control status, or causes the second telephoto camera to capture a fourth image of the second vehicle after a second predetermined time period from the instant of time of the change of traffic control status.

14. The image recording apparatus of claim 13 wherein the control circuit causes the recording of each of the third image or fourth image to permanent memory.

15. The image recording apparatus of claim 11 further comprising a compression circuit configured to the image size of the first image or the second image.

16. The image recording apparatus of claim 15 wherein the compression circuit performs digital compression.

17. The image recording apparatus of claim 11 wherein each of the first telephoto camera and second telephoto camera are digital cameras.

18. The image recording apparatus of claim 11 wherein the temporary memory comprises RAM.

19. The image recording apparatus of claim 12 wherein the permanent memory comprises a WORM device.

20. The image recording apparatus of claim 11 wherein the detection circuit includes an inductive loop set below a road surface proximate to the intersection, and wherein the trigger location comprises a stop line marked on a roadway proximate said intersection.

* * * * *